US006209506B1

(12) United States Patent
Satou

(10) Patent No.: US 6,209,506 B1
(45) Date of Patent: Apr. 3, 2001

(54) CYLINDER HEAD FOR INTERNAL COMBUSTION ENGINE

(75) Inventor: Seigou Satou, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/549,070

(22) Filed: Apr. 13, 2000

(30) Foreign Application Priority Data

Apr. 22, 1999 (JP) ..... 11-115125

(51) Int. Cl.[7] ..... F02F 1/24
(52) U.S. Cl. ..... 123/193.5
(58) Field of Search ..... 123/193.5, 635, 123/298, 90.23

(56) References Cited

U.S. PATENT DOCUMENTS 5,101,777 * 4/1992 Onishi et al. ..... 123/90.23
5,307,785 * 5/1994 Yoshikawa ..... 123/635
5,775,288 * 7/1998 Suzuki et al. ..... 123/298

FOREIGN PATENT DOCUMENTS 344597 12/1989 (EP) .
0422277 4/1991 (EP) .

* cited by examiner

*Primary Examiner*—Marguerite McMahon
(74) *Attorney, Agent, or Firm*—Foley & Lardner

(57) ABSTRACT

A cylinder head of a spark-ignition engine is divided into an upper cylinder head portion and a lower cylinder head portion by means of a division wall portion. An upper spark-plug hole is formed in the upper cylinder head portion, whereas a lower spark-plug hole is formed in the lower cylinder head portion. The relative position of lower spark-plug hole is based on the position of the spark plug screwed into a tapped hole formed in the lower cylinder head portion. The relative position of the upper spark-plug hole is based on engine parts mounted in the upper cylinder head. The axis of the upper spark-plug hole is thus designed to be offset from the axis of the lower spark-plug hole. Each of the upper and lower spark-plug holes has a tapered hollow portion in close vicinity to the division wall portion. Alternatively, the lower spark-plug hole is diametrically enlarged in comparison with the upper spark-plug hole, so that the lower spark-plug hole surrounds the entire circumference of the upper spark-plug hole.

8 Claims, 3 Drawing Sheets

CYLINDER HEAD FOR INTERNAL COMBUSTION ENGINE

BACKGROUND OF THE INVENTION

1. Field of the Invention

The present invention relates to a cylinder head for an internal combustion engine, and particularly to the improvements of a cylinder head structure for a spark-ignited internal combustion engine capable of more compactly mounting related parts, such as intake and exhaust valves, a spark plug, and engine valve operating units, in place.

2. Description of the Prior Art

As is generally known, the installation position of a spark plug on an engine cylinder head (relating to the shape of a combustion chamber) plays a very important part in a combustion quality. For maximizing engine performance, a pent-roof type is often used as a typical combustion-chamber shape. In such high-performance engines with pent-roof combustion chambers, a spark plug is generally located substantially in the center of the pent-roof combustion chamber, for shortening a flame propagation distance and thus promoting good combustion. Also, on engines with pent-roof combustion chambers, a spark-plug hole bored or drilled in an engine cylinder head for spark-plug installation/removal, is usually formed as a straight through-opening which communicates the substantially center of the pent-roof combustion chamber and is drilled downwards from the upper part of the engine. However, in such engines having straight spark-plug holes, engine-valve's related parts mounted on the cylinder head are restricted in layout due to the necessity for providing a desired thickness between the spark-plug hole and each of the valve's related parts. To put it concretely, the installation position of the valve operating unit, which operates intake and/or exhaust valves, is limited by the straight spark-plug-holes drilled in the cylinder head. The engine valve must be arranged in due consideration of the shape of the combustion chamber. Also, it is desirable to produce an optimal gas flow (of less energy loss) both on intake stroke and on exhaust stroke. For the reasons mentioned above, the inclination and size (particularly, the size of valve head) of intake valve is designed to be usually different from those of exhaust valve. Usually, the inclination of intake valve is steeper than that of exhaust valve. Thus, if the spark plug is arranged in the cylinder head in a manner so as to satisfy the combustion quality as discussed above, respective valve operating units related to intake and exhaust valves would be arranged in the cylinder head far away from the combustion chamber, owing to the design difference between the intake and exhaust valves. In recent years, there have been proposed and developed various automotive electromagnetically-powered valve operating apparatus each having electromagnetically-operated valve units for electromagnetically opening and closing intake and exhaust valves. On engines with electromagnetically-powered valve operating apparatus, there is an increased tendency for valve units to be arranged far away from the combustion chamber. Commonly, a combination of the electromagnetically-powered valve operating apparatus and the previously-noted straight spark-plug hole opening to the combustion chamber, results in an increased cylinder-head overall height (consequently, an increased engine overall height). This is contrary to demands for lightweight, small-sizing, and reduced engine production costs.

SUMMARY OF THE INVENTION

Accordingly, it is an object of the invention to provide a cylinder head for an internal combustion engine, which avoids the aforementioned disadvantages of the prior art.

It is another object of the invention to provide a cylinder head for a spark-ignition internal combustion engine, which is capable of more compactly mounting a variety of related parts, such as intake and exhaust valves, a spark plug, and engine valve operating units, without deteriorating the combustion quality, by virtue of a specific spark-plug hole and cylinder-head structure.

In order to accomplish the aforementioned and other objects of the present invention, a cylinder head of a spark-ignition engine having at least one spark-plug hole through which a spark plug is screwed into a tapped hole portion, comprises a division wall portion which divides the cylinder head into an upper cylinder head portion and a lower cylinder head portion, an upper spark-plug hole formed in the upper cylinder head portion, and a lower spark-plug hole formed in the lower cylinder head portion, wherein an axis of the upper spark-plug hole and an axis of the lower spark-plug hole are offset from each other.

According to another aspect of the invention, a method for removing a spark plug from a tapped hole portion formed in a cylinder head of a spark-ignition engine having at least one spark-plug hole through which the spark plug is screwed into the tapped hole portion, in which the cylinder head includes a division wall portion for dividing the cylinder head into an upper cylinder head portion and a lower cylinder head portion, an upper spark-plug hole formed in the upper cylinder head portion, and a lower spark-plug hole formed in the lower cylinder head portion, and wherein an axis of the upper spark-plug hole and an axis of the lower spark-plug hole are offset from each other, the method comprises removing the spark plug from the tapped hole portion by a plug wrench, drawing the spark plug upwardly after removal of the spark plug from the tapped hole portion, and further drawing up the spark plug towards within the upper spark-plug hole via the division wall portion.

According to another aspect of the invention, a method for installing a spark plug into a tapped hole portion formed in a cylinder head of a spark-ignition engine having at least one spark-plug hole through which the spark plug is screwed into the tapped hole portion, in which the cylinder head includes a division wall portion for dividing the cylinder head into an upper cylinder head portion and a lower cylinder head portion, an upper spark-plug hole formed in the upper cylinder head portion, and a lower spark-plug hole formed in the lower cylinder head portion, and wherein an axis of the upper spark-plug hole and an axis of the lower spark-plug hole are offset from each other, the method comprises inserting the spark plug downwardly into the upper spark-plug hole by a plug wrench, further inserting the spark plug downwardly towards within the lower spark-plug hole via the division wall portion, and screwing the spark plug into the tapped hole portion formed in the lower cylinder head portion.

DESCRIPTION OF THE PREFERRED EMBODIMENTS

Figure 1:
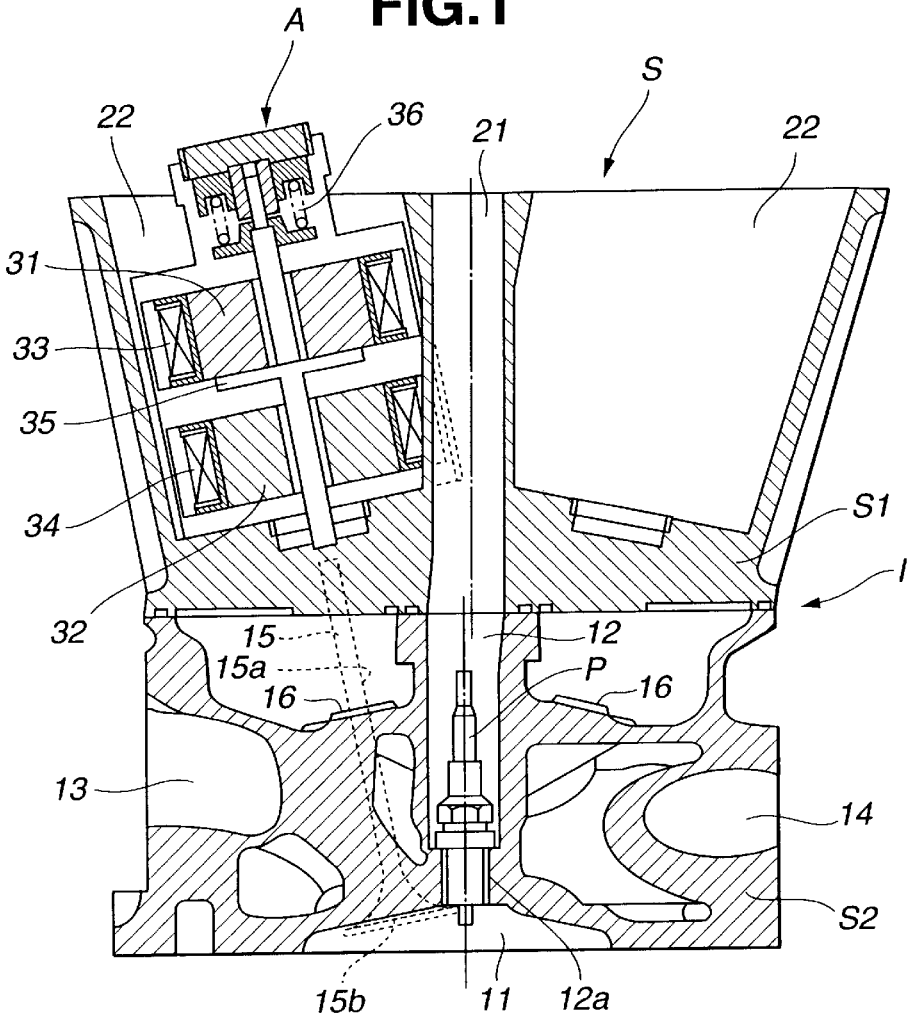
FIG. 1 is a sectional view illustrating an embodiment of a specific engine cylinder head of the invention.
Figure 2:
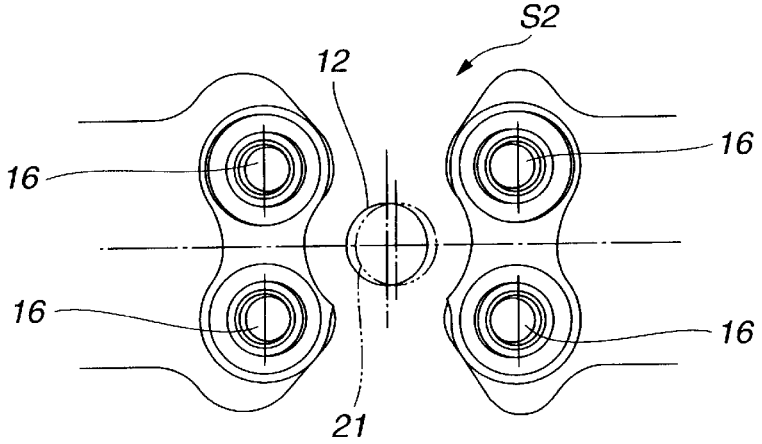
FIG. 2 is a partial plan view illustrating a lower half of the cylinder head of the embodiment shown in FIG. 1.

Referring now to the drawings, particularly to FIGS. 1 and 2, the engine cylinder head S of the invention is exemplified in case of a spark-ignited, four-valve internal combustion engine with pent-roof combustion chambers and electromagnetically-powered valve operating apparatus. In FIG. 1, reference sign A denotes an electromagnetically-operated valve unit (an electromagnetic valve actuator) which is provided for electromagnetically opening and closing intake and exhaust valves. As best seen in FIG. 2, the engine is a four-valve internal combustion engine having four valves (two intake valves and two exhaust valves) in each cylinder. Thus, the engine has four electromagnetic valve actuators (A, A, A, A) in each engine cylinder. Reference sign P denotes a spark plug which is located substantially in the center of the combustion chamber. In the engine cylinder head S of the embodiment, note that the cylinder head S can be divided into two cylinder head portions, namely an upper cylinder head portion S1 and a lower cylinder head portion S2, by a division wall portion I. The upper and lower cylinder head portions S1 and S2 are integrally connected or assembled to each other at the division wall portion I, and then the cylinder head assembly is mounted on a cylinder block (not shown). In a conventional manner, a cylinder-head gasket (not shown) is installed between the bottom face of the cylinder head S (the lower cylinder head portion S2) and the upper face of the cylinder block to provide a good seal. For the sake of simplicity, the cylinder block and the piston are omitted, and only a combustion chamber 11 is shown. The combustion chamber 11 is a pent-roof type, and defined between the bottom face of the cylinder head S and the top (piston crown) of the piston reciprocating in the cylinder formed in the cylinder block.

The lower cylinder head portion S2 is formed with a lower spark-plug hole 12 for each engine cylinder. The lower spark-plug hole 12 includes a substantially cylindrical vertical bore extending from the upper face of the lower cylinder head portion S2 to the pent-roof combustion chamber 11, and communicating at its upper end with an upper spark-plug hole 21 (which will be fully described later) under a particular condition where the two separate cylinder head portions S1 and S2 are assembled to each other. The lower spark-plug hole 12 also includes an internal screw-threaded portion (a tapped hole) 12*a* which is formed in the lower cylinder head portion S2 in a manner so as to be continuous with the lower opening of the substantially cylindrical bore. The spark plug P is screwed into the tapped hole 12*a* in the lower cylinder head portion S2, so that a pair of electrodes of the spark plug P are exposed to the combustion chamber to provide a spark gap in the combustion chamber 11. The lower cylinder head portion S2 is also formed with intake ports 13 through which intake air is drawn into the respective combustion chambers 11, and exhaust ports 14 through which exhaust gases are exhausted. In the engine shown in FIG. 1, the intake and exhaust ports are formed in the lower cylinder head portion S2 in such a manner as to extend in a direction substantially perpendicular to the cylinder row direction. Although it is not clearly shown in FIG. 1, the lower cylinder head portion S2 is also formed with another holes or bores, such as intake-valve-guide holes and exhaust-valve-guide holes. As may be appreciated from the cross section shown in FIG. 1, the spark plug P is installed at an optimal position capable of providing a good combustion quality, without interfering with the intake port 13, the exhaust port 14, the other engine parts such as intake and exhaust valves and related parts.

On the other hand, the upper head portion S1 is formed with the upper spark-plug hole 21 for each engine cylinder. The upper spark-plug hole 21 includes a substantially cylindrical vertical bore extending from the upper face of the upper cylinder head portion S1 to the bottom face of the upper cylinder head portion S1, and communicating the upper opening of the substantially cylindrical vertical bore of the lower spark-plug hole 12. The upper cylinder head portion S1 is also formed with four electromagnetic-valve-actuator mounting holes (22, 22, 22, 22) for two electromagnetically-operated intake valve units (two intake-valve side electromagnetic valve actuators) and two electromagnetically-operated exhaust valve units (two exhaust-valve side electromagnetic valve actuators). The upper spark-plug hole 21 (the substantially cylindrical vertical bore) is substantially centrally formed in the upper cylinder head portion S1 without interfering with the four actuator mounting holes, so that a predetermined thickness can be secured between the upper spark-plug hole 21 and each of the actuator mounting holes (22, 22, 22, 22). For the purpose of illustrative simplicity, only the intake-valve side electromagnetic valve actuator unit A is shown. The actuator unit A is comprised of upper and lower cores 31 and 32 spaced apart from each other a predetermined axial distance, and each containing a magnetic material. An upper electromagnetic coil 33 is wound on the upper core 31, while a lower electromagnetic coil 34 is wound on the lower core 32. The intake-valve side actuator unit A also includes a contact (not numbered) fitted to the valve stem 15*a* of the engine valve 15, a movable flanged plunger unit 35 containing a magnetic material and having a plunger rod portion whose lower end is in abutted engagement with the contact. The upper and lower electromagnetic coils 33 and 34 are coaxially around the plunger rod of the flanged plunger unit 35 in a manner so as to respectively face to the upper and lower flat-faced surfaces of the flanged portion of the flanged plunger unit 35. An upper coil spring unit 36 permanently biases the valve stem 15*a* in a direction closing the engine valve 15, whereas a lower coil spring unit (not shown) permanently biases the valve stem 15*a*in a direction opening the engine valve 15. The lower coil spring unit (not shown) includes a coiled helical compression spring and a spring retainer fixedly connected to the valve stem 15*a* for retaining one end of the coiled helical compression spring. The other end of the coiled helical compression spring of the lower coil spring unit is seated on a spring seat (not numbered) fixed to the upper cylinder head S1. The upper coil spring unit 36 is located at the upper end of the intake-valve side actuator unit A in such a manner as to permanently spring-load the upper end of the plunger rod of the flanged plunger unit 35 in the opening direction of the engine valve 15. Similarly to the lower coil spring unit, the upper coil spring unit 36 includes a coiled helical compression spring, a spring retainer fixedly connected to the uppermost end of the plunger rod of the flanged plunger unit 35 for retaining one end of the coiled helical compression spring, and a cylindrical hollow spring casing which holds a spring seat for the other end of the coiled helical compression spring. When the lower electromagnetic coil 34 of the intake-valve side actuator unit A is activated, the flanged portion of the flanged plunger unit 35 is attracted downwards in one axial direction of the plunger rod by way of attraction force (electromagnetic force electromagnetically produced) created by the coil 34 energized, with the result that the engine valve 15 is opened. Conversely, when the upper electromagnetic coil 33 of the intake-valve side actuator unit A is activated, the flanged portion of the flanged plunger unit 35 is attracted upwards in the other axial direction of the plunger rod by way of attraction force created by the coil 33 energized, with the result that the engine valve 15 is closed. The helical compression spring of the lower coil spring unit is provided for holding the closed state of the engine valve 15, whereas the helical compression spring of the upper coil spring unit 36 is provided for holding the opened state of the engine valve 15. In the shown embodiment, the coiled helical spring of the lower coil spring unit has almost the same standard (the same specification, that is, the same spring stiffness and the same spring size and dimensions) as that of the upper coil spring unit 36. The upper and lower electromagnetic coils (33, 34) and the upper and lower coil spring units cooperate with each other to electromagnetically open and close the engine valve 15 by way of electromagnetic force plus spring bias. When the electromagnetic coils 33 and 34 are both de-energized, the plunger unit is maintained at its neutral position (an intermediate position substantially midway between the valve closed position and the valve full-open position) together with the engine valve 15. With the previously-noted arrangement of the electromagnetic valve actuator unit A, it is possible to reciprocate the movable flanged plunger unit 35 by virtue of attraction force (electromagnetic force produced by excitation of each of the coils 33 and 34). The reciprocating motion of the flanged plunger unit 35 included in the intake-valve side actuator unit A is transmitted to the engine valve 15 (intake valve), while the reciprocating motion of the flanged plunger unit 35 included in the exhaust-valve side actuator unit A is transmitted to the engine valve 15 (exhaust valve). In this manner, an intake-valve open timing (IVO), an intake-valve closure timing (IVC), an exhaust-valve open timing (EVO), and an exhaust-valve closure timing (EVC) can be arbitrarily controlled by electronically controlling the four electromagnetic actuator units (A, A, A, A) associated with each of the engine cylinder. In such electromagnetically-powered engine valves 15, to provide an optimal gas flow both on intake stroke and on exhaust stroke, a size and dimensions (exactly, the size of valve head 15*b* and the inclination of valve stem 15*a*) of an electromagnetically-powered intake valve are different from those of an electromagnetically-powered exhaust valve. For the reasons set out above, in the cylinder head structure of the embodiment, as shown in FIGS. 1 and 2, the axis of the upper spark-plug hole 21 formed in the upper cylinder head portion S1 is slightly offset from the axis of the lower spark-plug hole 12 of the lower cylinder head portion S2, toward the exhaust valve side, accounting for the design difference (the valve-head size and the valve-stem inclination) between intake and exhaust valves (see the central bore 12 indicated by the solid line of FIG. 2 slightly offset from the central bore 21 indicated by the two-dotted line of FIG. 2). In FIG. 2, the left-hand two parts denoted by 16 are intake-valve guides, whereas the right-hand two parts denoted by 16 are exhaust-valve guides. The offset arrangement between the upper and lower spark-plug holes 21 and 12 is useful or effective to provide or bore the electromagnetic-valve-actuator mounting holes 22 in the upper cylinder head portion S1 at a position closer to the combustion chamber 11 rather than a case that the axis of the upper spark-plug hole 21 is axially aligned with the axis of the lower spark-plug hole 12. According to the cylinder head structure of the embodiment, it is possible to relax restriction on layout which restriction may occur owing to the position of installation of the spark plug P, when arranging various parts, namely the electromagnetic valve actuators A, the intake and exhaust valves, and related parts, in the upper cylinder head S1. Thus, it is possible to more properly form the electromagnetic-valve-actuator mounting holes 22 in the upper cylinder head portion S1, as close to the combustion chamber 11 as possible. As a result of this, the overall height of the engine can be reduced, thus ensuring lightweight and small-sizing of the engine. Additionally, the axial length of the movable flanged plunger unit 35 can be shortened, thereby reducing electric power consumption used for opening and closing actions for the engine valve 15.

Figure 3A:
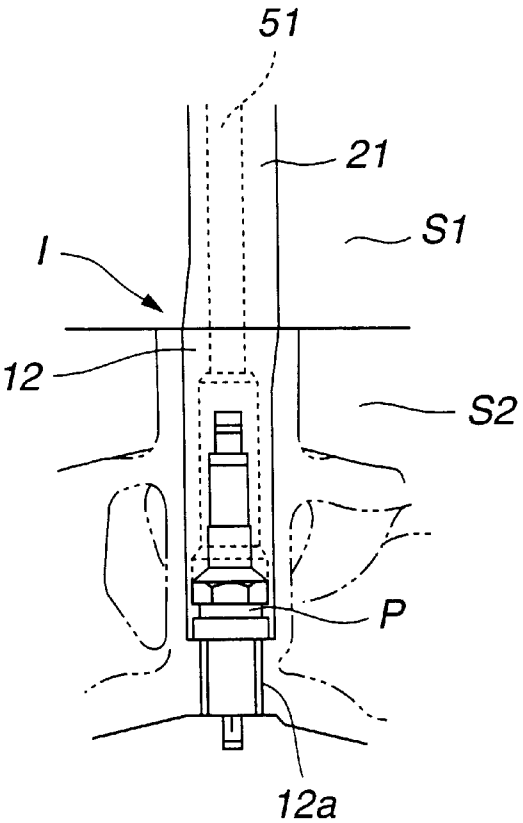
FIGS. 3A, 3B and 3C are explanatory views showing removal procedure of the spark plug from the cylinder head of the embodiment.
Figure 3B:
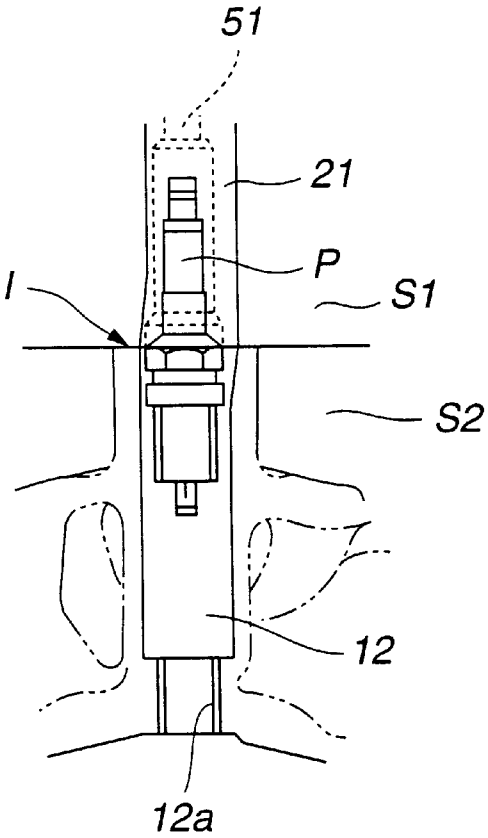
Figure 3C:
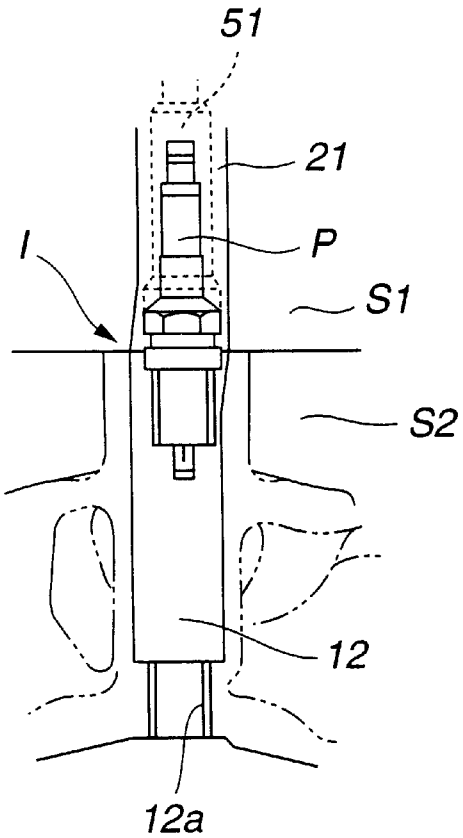

As can be appreciated from the cross section of FIG. 1, the upper spark-plug hole 21 is comprised of two portions, namely a major cylindrical hollow portion having a same circular shape in lateral cross section, and a minor oblique frusto-conical hollow portion (simply a tapered hollow portion) constructing the lower end of the upper spark-plug hole 21. The lower tapered hollow portion of the upper spark-plug hole 21 is formed in the upper cylinder head portion S1 in such a manner as to be gradually diametrically enlarged from the lowermost end of the major cylindrical hollow portion to the division wall portion I. On the other hand, the lower spark-plug hole 12 is comprised of three portions, namely a tapped hole portion into which the spark plug P is screwed, a major intermediate cylindrical hollow portion having a same circular shape in lateral cross section, and aminor oblique frusto-conical hollow portion (simply a tapered hollow portion) constructing the upper end of the lower spark-plug hole 12. The upper tapered hollow portion of the lower spark-plug hole 12 is formed in the lower cylinder head portion S2 in such a manner as to be gradually diametrically enlarged from the uppermost end of the major intermediate cylindrical hollow portion to the division wall portion I. The lowermost opening end of the lower tapered hollow portion of the upper spark-plug hole 21 formed in the upper cylinder head portion S1 connects smoothly continuously with the uppermost opening end of the upper tapered hollow portion of the lower spark-plug hole 12 formed in the lower cylinder head portion S2. As discussed above, the upper spark-plug hole 21 is smoothly continuous with the lower spark-plug hole 12 by means of the two oblique frusto-conical hollow portions respectively formed in the lower end of the upper spark-plug hole 21 and in the upper end of the lower spark-plug hole 12. Thus, a work efficiency can be remarkably enhanced when the spark plug P is installed into or removed from the tapped hole portion through the major intermediate cylindrical hollow portion and the upper tapered hollow portion both included in the lower spark-plug hole 12, and the lower tapered hollow portion and the major cylindrical hollow portion both included in the upper spark-plug hole 21. In the shown embodiment, although the lower tapered hollow portion of the upper spark-plug hole 21 and the upper tapered hollow portion of the lower spark-plug hole 12 are both provided, it is preferable to provide at least one of the upper and lower tapered hollow portions in the two-split cylinder head S, to enable the smooth installation/removal of the spark plug P. FIGS. 3A–3C show the removal procedure of the spark plug P from the upper and lower spark plug holes (21, 12). As appreciated from a change of state from the spark-plug position shown in FIG. 3A to the spark-plug position shown in FIG. 3B, the spark plug P is removed from the tapped hole 12*a* by means of a plug wrench (a socket wrench) 51. Then, the spark plug P is drawn upwardly towards within the lower spark-plug hole 12. Thereafter, the spark plug P is further drawn up towards within the upper spark-plug hole 21 via the upper tapered hollow portion (included in the lower spark-plug hole 12) and the lower tapered hollow portion (included in the upper spark-plug hole 21) being smoothly continuous with each other (see FIGS. 3B and 3C), both tapered hollow portions formed in close vicinity to the division wall portion I. In this manner, the spark plug P can be easily removed from the spark-plug holes (12, 21). Conversely, when installing the spark plug into the tapped hole 12*a*, by virtue of the previously-discussed tapered hollow portions, it is possible to easily install the spark plug P into the tapped hole 12*a* through the major cylindrical hollow portion and the lower tapered hollow portion both included in the upper spark-plug hole 21, and the upper tapered hollow portion and the major intermediate cylindrical hollow portion both included in the lower spark-plug hole 12, in reverse order of the removal procedures. That is, the spark plug P is inserted, first of all, downwardly into the upper spark-plug hole 21 by means of the plug wrench (see FIG. 3C). Then, the spark plug P is further inserted downwardly towards within into the lower spark-plug hole 12 via the division wall portion I (see FIG. 3B). Thereafter, the spark plug P is screwed into the tapped hole portion 12*a* (see FIG. 3A).

Figure 4:
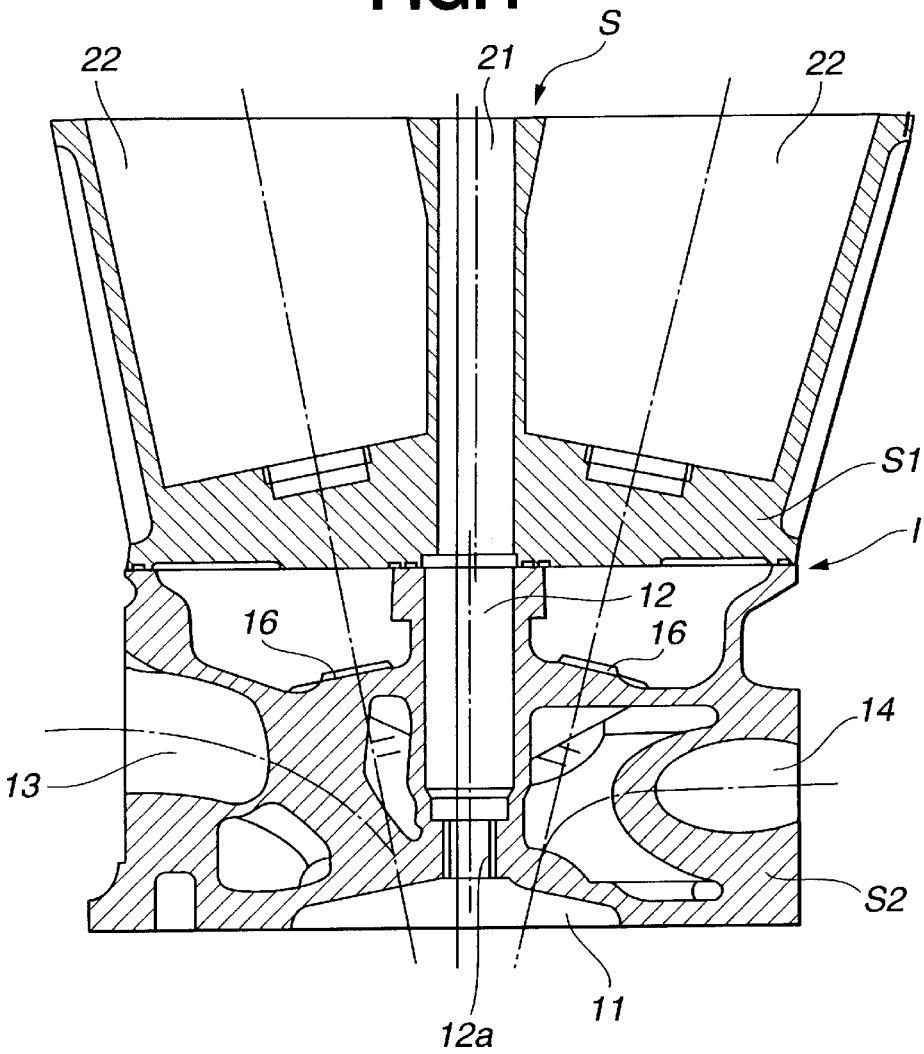
FIG. 4 is a sectional view illustrating a modified specific engine cylinder head of the invention.
Figure 5:
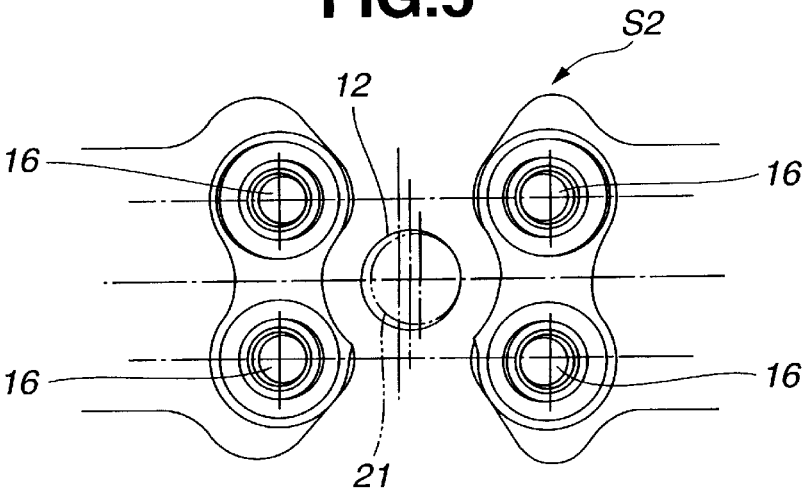
FIG. 5 is a partial plan view illustrating a lower half of the modified cylinder head shown in FIG. 4.

Referring now to FIGS. 4 and 5, there is shown the modified cylinder head structure. The modified cylinder head structure shown in FIGS. 4 and 5 is similar to the cylinder head structure of the embodiment shown in FIGS. 1 and 2. Thus, the same reference signs used to designate reference signs in the cylinder head structure of the embodiment shown in FIGS. 1 and 2 will be applied to the corresponding reference signs used in the modified cylinder head structure shown in FIGS. 4 and 5, for the purpose of comparison of the two slightly different cylinder head structures. Only the modified spark-plug hole structure will be hereinafter described in detail with reference to FIGS. 4 and 5, while detailed description of the other structure will be omitted because the above description thereon seems to be self-explanatory. In the same manner as the cylinder head structure of the embodiment shown in FIGS. 1 and 2, in the modified cylinder head structure shown in FIGS. 4 and 5, the axis of the upper spark-plug hole 21 is slightly offset from the axis of the lower spark-plug hole 12. The upper spark-plug hole 21 is substantially centrally formed in the upper cylinder head portion S1 without interfering with each of the engine parts, such as the electromagnetic valve actuators A, so that a predetermined thickness can be secured between the upper spark-plug hole 21 and each of the actuator mounting holes 22. Also, the lower spark-plug hole 21 is formed in the lower cylinder head portion S2, so that the spark plug P is installed at an optimal position capable of providing a good combustion quality, without interfering with the intake port, the exhaust port, intake and exhaust valves and related parts. The modified cylinder head structure shown in FIGS. 4 and 5 is somewhat different from that of the embodiment shown in FIGS. 1 and 2, in the structural design (the shape and dimensions) of the upper and lower spark-plug holes, as detailed hereunder.

The modified cylinder head structure of FIGS. 4 and 5 does not have the lower oblique frusto-conical hollow portion (the lower tapered hollow portion) of the upper spark-plug hole 21 and the upper oblique frusto-conical hollow portion (the upper tapered hollow portion) of the lower spark-plug hole 12, in the vicinity of the division wall portion I. As seen in FIGS. 4 and 5, particularly, as appreciated from the cross section of FIG. 5, the upper spark-plug hole 21 is comprised of a major cylindrical hollow portion and a lower counter bore portion. The lower spark-plug hole 12 is comprised of three portions, namely a tapped hole portion into which the spark plug P is screwed, a comparatively small-diameter intermediate diametrically-diminished portion, and a comparatively large-diameter major cylindrical hollow portion having a same circular shape in lateral cross section. The previously-noted lower counter bore portion of the upper spark-plug hole 21 is machined slightly eccentrically to the axis of the cylindrical hollow portion of the upper spark-plug hole 21, and axially aligned with respect to the axis of the comparatively large-diameter cylindrical hollow portion of the lower spark-plug hole 12. In the modified cylinder head structure of FIGS. 4 and 5, note that the lower spark-plug hole 12 is diametrically enlarged to such an extent that the comparatively large-diameter cylindrical hollow portion of the lower spark-plug hole 12 surrounds the entire circumference of the cylindrical hollow portion of the upper spark-plug hole 21 (see the central bore 21 indicated by the two-dotted line of FIG. 5, surrounded by the central bore 12 indicated by the solid line of FIG. 5). In comparison with the sparkplug hole with the tapered hollow portion (exactly, the oblique frusto-conical hollow portion) as shown in FIGS. 1 and 2, it is easy to machine the spark-plug hole with no tapered hollow portion. Additionally, the modified cylinder head structure of FIGS. 4 and 5 has the same effects as that shown in FIGS. 1 and 2. That is to say, according to the modified cylinder head structure, it is possible to relax restriction on layout which restriction may occur due to the position of the installation of the spark plug P, when arranging A, the intake and exhaust valves, and related parts, in the upper cylinder head S1. Thus, the overall height of the engine can be reduced. The modified cylinder head structure also contributes to light-weight and small-sizing of the engine. Also, the axial length of the movable flanged plunger unit 35 can be shortened, thus reducing electric power consumption used for opening and closing actions for the engine valve 15. Furthermore, when installing or removing the spark plug P into or from the tapped hole portion 12*a*, the diametrically-enlarged cylindrical hollow portion of the lower spark-plug hole 12 insures the ease of installation/removal.

As will be appreciated from the above, according to the cylinder head structure of the invention, the spark plug P can be installed at an optimal position capable of providing a good combustion quality, while engine parts, such as the electromagnetic valve actuators, can be properly arranged in the upper cylinder head portion S1. This enhances lay-out flexibility (design flexibility). Therefore, it is possible to reduce the entire height of the engine without lowering the rigidity of the cylinder head S. Also, it is possible to small-size and to lighten the engine itself. Moreover, assuming that the fundamental concept of the invention is applied to an internal combustion engine with an electromagnetically-powered valve operating apparatus, the overall length of a movable flanged plunger unit of an electromagnetic valve actuator can be shortened, and whereby electric power consumption can effectively be reduced.

The entire contents of Japanese Patent Application No. P11-115125 (filed Apr. 22, 1999) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A cylinder head of a spark-ignition engine having at least one spark-plug hole through which a spark plug is screwed into a tapped hole portion, comprising:

a division wall portion which divides the cylinder head into a separable upper cylinder head portion and a separable lower cylinder head portion;

an upper spark-plug hole formed in the upper cylinder head portion; and a lower spark-plug hole formed in the lower cylinder head portion;

wherein an axis of the upper spark-plug hole and an axis of the lower spark-plug hole are offset from each other.

2. The cylinder head as claimed in claim 1, wherein at least one of the upper and lower spark-plug holes has a tapered hollow portion diametrically enlarged in a tapered fashion at an end of the at least one of the upper and lower spark-plug holes, facing to the partition wall portion, and the end of the at least one of the upper and lower spark-plug holes and another end of the upper and lower spark-plug holes, facing to the partition wall portion are smoothly connected to each other.

3. The cylinder head as claimed in claim 1, wherein the lower spark-plug hole is diametrically enlarged in comparison with the upper spark-plug hole, so that the lower spark-plug hole surrounds an entire circumference of the upper spark-plug hole.

4. The cylinder head as claimed in claim 3, wherein the upper spark-plug hole comprises a major cylindrical hollow portion and a counter bore portion, and the lower spark-plug hole comprises a tapped hole portion, a comparatively small-diameter intermediate portion, and a comparatively large-diameter major cylindrical hollow portion, and the counter bore portion of the upper spark-plug hole is machined eccentrically to an axis of the major cylindrical hollow portion of the upper spark-plug hole and axially aligned with respect to an axis of the comparatively large-diameter cylindrical major hollow portion of the lower spark-plug hole.

5. The cylinder head as claimed in claim 1, wherein the upper cylinder head portion has a plurality of electromagnetic-valve-actuator mounting holes for electromagnetically-operated intake valve units and electromagnetically-operated exhaust valve units, and the upper spark-plug hole is offset with respect to the lower spark-plug hole, without interfering with the plurality of electromagnetic-valve-actuator mounting holes.

6. The cylinder head as claimed in claim 1, wherein the upper spark-plug hole has an oblique frusto-conical hollow portion at a lower end facing to the partition wall portion, and the lower spark-plug hole has an oblique frusto-conical hollow portion at an upper end facing to the partition wall portion, and a lowermost opening end of the oblique frusto-conical hollow portion of the upper spark-plug hole connects smoothly continuously with an uppermost opening end of the oblique frusto-conical hollow portion of the lower spark-plug hole.

7. A method for removing a spark plug from a tapped hole portion formed in a cylinder head of a spark-ignition engine having at least one spark-plug hole through which the spark plug is screwed into the tapped hole portion, in which the cylinder head includes a division wall portion for dividing the cylinder head into a separable upper cylinder head portion and a separable lower cylinder head portion, an upper spark-plug hole formed in the upper cylinder head portion, and a lower spark-plug hole formed in the lower cylinder head portion, and wherein an axis of the upper spark-plug hole and an axis of the lower spark-plug hole are offset from each other, the method comprising:

removing the spark plug from the tapped hole portion by a plug wrench;

drawing the spark plug upwardly after removal of the spark plug from the tapped hole portion; and further drawing up the spark plug towards within the upper spark-plug hole via the division wall portion.

8. A method for installing a spark plug into a tapped hole portion formed in a cylinder head of a spark-ignition engine having at least one spark-plug hole through which the spark plug is screwed into the tapped hole portion, in which the cylinder head includes a division wall portion for dividing the cylinder head into a separable upper cylinder head portion and a separable lower cylinder head portion, an upper spark-plug hole formed in the upper cylinder head portion, and a lower spark-plug hole formed in the lower cylinder head portion, and wherein an axis of the upper spark-plug hole and an axis of the lower spark-plug hole are offset from each other, the method comprising:

inserting the spark plug downwardly into the upper spark-plug hole by a plug wrench;

further inserting the spark plug downwardly towards within the lower spark-plug hole via the division wall portion; and screwing the spark plug into the tapped hole portion formed in the lower cylinder head portion.

* * * * *